US005623879A

United States Patent [19]

Gersemsky et al.

[11] Patent Number: 5,623,879

[45] Date of Patent: Apr. 29, 1997

[54] TRAVELLING MECHANISM FOR HOISTING EQUIPMENT

[75] Inventors: Udo Gersemsky, Herdecke; Karl Liebig, Wetter; Thomas Schweflinghaus, Wuppertal, all of Germany

[73] Assignee: Mannesmann Aktiengesellschaft, Dusseldorf, Germany

[21] Appl. No.: 423,162

[22] Filed: Apr. 17, 1995

[30] Foreign Application Priority Data

Apr. 15, 1994 [DE] Germany ..... 44 13 537.8

[51] Int. Cl.[6] ..... B61B 3/00

[52] U.S. Cl. ..... 105/150; 105/153; 105/163.1; 104/93

[58] Field of Search ..... 104/89, 93, 95, 104/118, 119; 105/141, 144, 148, 150, 153, 154, 163.1

[56] References Cited

U.S. PATENT DOCUMENTS

| | | | |
|---|---|---|---|
| 4,716,839 | 1/1988 | Catena | 105/153 |
| 5,213,045 | 5/1993 | Gersemsky | 104/93 |
| 5,303,656 | 4/1994 | Makimura et al. | 105/144 |

FOREIGN PATENT DOCUMENTS

| | | | |
|---|---|---|---|
| 345509 | 9/1978 | Austria . | |
| 0505016A1 | 9/1992 | European Pat. Off. . | |
| 1288269 | 1/1969 | Germany . | |
| 4109971A1 | 9/1992 | Germany . | |
| 471256 | 5/1975 | U.S.S.R. | 104/93 |
| 2225996 | 6/1990 | United Kingdom | 104/93 |

*Primary Examiner*—S. Joseph Morano
*Attorney, Agent, or Firm*—Cohen, Pontani, Lieberman, Pavane

[57] ABSTRACT

A travelling mechanism for hoisting equipment, especially for hoisting equipment which runs on monorail flange beams that have, along with straight sections, elevated and/or laterally curved sections. The travelling mechanism has side shield members located across from one another and on each of which at least one travelling wheel is mounted as are pairs of side guide rollers between which the travelling wheels are arranged. A travelling drive and curve travelling device, which travelling device can be positioned against the monorail flange beam by springs, are also connected to the travelling mechanism. The travelling device is provided on at least one side shield member as a rotatably-mounted sprung one-armed pivot lever on an end of which an auxiliary side guide roller is rotatably mounted.

7 Claims, 2 Drawing Sheets

TRAVELLING MECHANISM FOR HOISTING EQUIPMENT

BACKGROUND OF THE INVENTION

1. Field of the Invention

The invention relates to a travelling mechanism for hoisting equipment, especially for hoisting equipment which runs on monorail flange beams. The travelling paths of the monorail flange beam have, in addition to straight sections, elevated and/or laterally curved sections. The travelling mechanism includes side shields located across from one another, on each of which at least one travelling wheel is mounted. Pairs of side guide rollers are mounted to the side shields and travelling wheels are arranged between the pairs of side guide rollers. A travelling drive and a curve travelling device are also provided and the travelling device. The curve travelling device can be positioned against the monorail flange beam by means of springs.

2. Discussion of the Prior Art

A travelling mechanism of this type is known (DE-41 09 971 A1) and is used for transporting loads, goods and/or persons on level and inclined curved monorail runways that have a double-T and box-type beam profile with any flange profile. Although the known monorail lower-flange travelling mechanism is a proven one, problems arise during the use of this known travelling mechanism when the radius of curvature of the runway changes from the horizontal to the vertical plane. The known travelling mechanism can therefore not be used for traversing all types of runways.

SUMMARY OF THE INVENTION

Accordingly, it is an object of the present invention to provide a travelling mechanism that permits the traversal of curves in the horizontal and the vertical plane, while the underside of the travelling flange remains free (e.g., for the use of a friction-gear drive) and is not configured, for example, with a helical spring.

Pursuant to this object and others which will become apparent hereafter, one aspect of the present invention resides in a travelling mechanism having a curve travelling device arranged on at least one side shield of the travelling mechanism as a rotatably-mounted sprung one-armed pivoted lever. An auxiliary side guide roller is rotatably mounted. The guide system thus works in horizontal and vertical planes or curves regardless of the shape of the beam. Furthermore, the inventive measures make it possible to traverse all forms of runways.

According to a further embodiment of the invention, the pivoted lever has one forked end that is rotatably mounted on an axis of a side guide roller of one of the pairs of side guide rollers arranged on the side shields and is rotatably-sprung by means of a torsion spring. Advantageously, a single axis can be provided for linking the pivoted lever, the side guide roller and the torsion spring, i.e., without requiring greater expenditure.

In still another embodiment of the invention, a pair of tip guide rollers is centrally arranged on the pivoted lever of the curve travelling device between a side guide roller and the auxiliary side guide roller. This central arrangement ensures that the travelling direction corresponds to the runway tangent and that no rolling occurs.

In an additional embodiment of the invention, at least one tilt guide roller is provided so as to be adjustable to different monorail flange beams, which allows different dimensions to be taken into account.

In a further embodiment of the invention, the side guide rollers arranged on the side shield have the same diameter as the auxiliary side guide roller arranged on the pivoted lever of the curve travelling device. This uniformity of diameters ensures that the travelling direction of the rollers runs parallel to the beam.

Moreover, in yet another embodiment, only one travelling wheel is provided between each pair of side guide rollers arranged on the side shields.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 3:
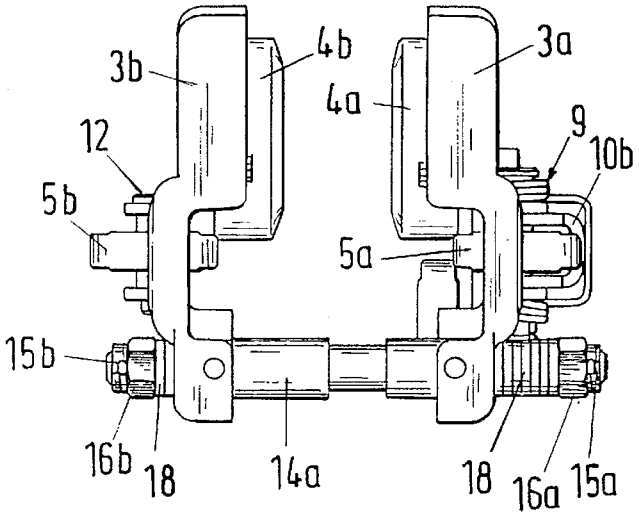
FIG. 3 is a side view of FIG. 1.
Figure 1:
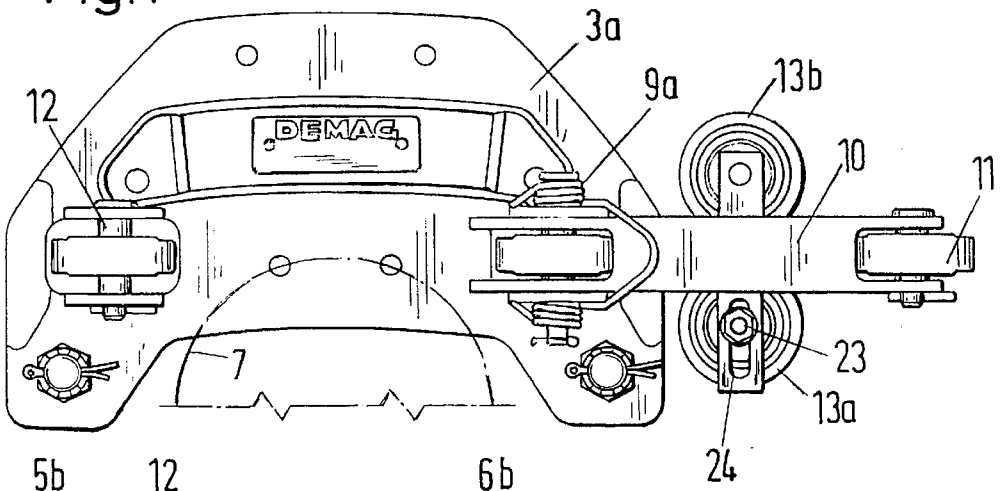
FIG. 1 is a side view of the inventive travelling mechanism with a curve travelling device.
Figure 2:
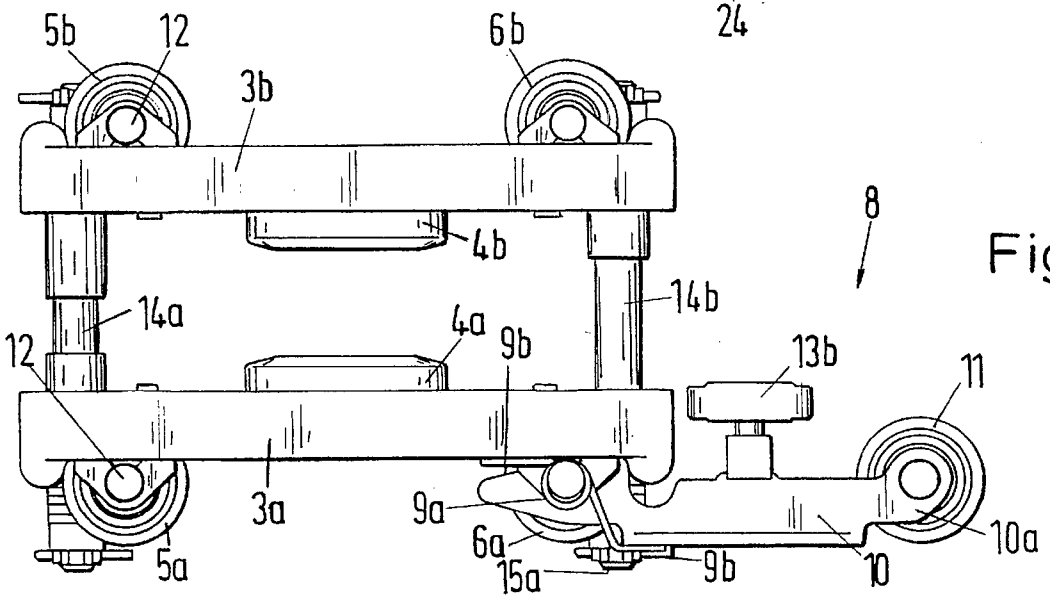
FIG. 2 is a top view of the travelling mechanism of FIG. 1.

The inventive travelling mechanism for hoisting equipment, such as units that travel on the lower-flange of a monorail, for example, runs on a monorail flange beam 1 (cf. FIG. 4) with elevated and/or laterally curved sections 2. The travelling mechanism includes a first side shield 3*a* and a second side shield 3*b* which are disposed facing and at a distance from one another. Travelling wheels 4*a*, 4*b* and side guide rollers 5*a*, 5*b*, 6*a*, 6*b* are rotatably mounted to the side shields 3*a*, 3*b* so that the travelling mechanism can be supported on the monorail flange. The travelling mechanism is driven via a travelling drive 7, which consists, for example, of a friction-gear drive. A special curve travelling device 8 (cf. FIG. 2) is provided which can be continuously positioned against the monorail flange beam 1 by springs 9 so as to follow the course of a particular curve of the beam 1.

The curve travelling device 8 can be arranged, for example, on one of the side shields 3*a*, 3*b* and includes a rotatably-mounted sprung one-armed pivoted lever 10.

The lever 10 has a free end 10*a* which is designed as a first forked end 10*a*. An auxiliary side guide roller 11 is rotatably mounted to the first forked end 10*a* of the lever 10 so that it can follow the curve of the side face of the monorail flange beam 1.

In order to follow the curve of the flange beam 1, the pivoted lever 10 is rotatably mounted at a second forked end 10*b* on an axis 12 of one side guide roller 6*a*, 6*b* of one of the pair of side guide rollers arranged on the side shield 3*a*, 3*b* and is spring loaded by a torsion spring 9*a*. The torsion spring 9*a* has spring legs 9*b*, which rest on the pivoted lever 10 and the side shield 3*a*.

Furthermore, a pair of tilt guide rollers 13*a*, 13*b* are rotatably mounted on the pivoted lever 10 centrally between the one side guide roller 6*a* and the auxiliary side guide roller 11. One of the two tilt guide rollers 13*a*, 13*b* is adjustable to the size of the monorail flange beam 1 by its axis 23 being movably arranged in a longitudinal slot 24 so that the one guide roller can be moved toward and away from the beam. The guide rollers 13*a*, 13*b* are rotatable about axes perpendicular to the rotation axes of the side guide rollers 6*a*, 6*b*.

The side guide rollers 5*a*, 5*b*; 6*a*, 6*b* that are rotatably mounted on the side shields 3*a*, 3*b*, have the same diameter as the auxiliary side guide roller 11 arranged on first forked end 10*a* of the pivoted lever 10 of the curve travelling device 8. Only one of the travelling wheels 4*a*, 4*b* is rotatably mounted between each pair of side guide rollers 5*a*, 5*b*; 6*a*, 6*b* of the side shields 3*a*, 3*b*.

The two side shields 3*a*, 3*b* are connected together in a known fashion by intermediate beams 14*a*, 14*b*, whereby the particular width of the monorail flange beam 1 can be accounted for by adjustment screws 15*a*, 15*b*and register nuts 16*a*, 16*b*. A change in width can be carried out by removing the spacers 18 from or by placing additional spacers onto the outer mediate beams. For the travelling wheels 4*a*, 4*b*, there are journal pins 17 mounted in the sheet-metal side shields 3*a*, 3*b*. The intermediate beam 14*a* (14*b*) and the adjustment screw 15*a* (15*b*) can be formed as a single piece, as shown.

Figure 4:
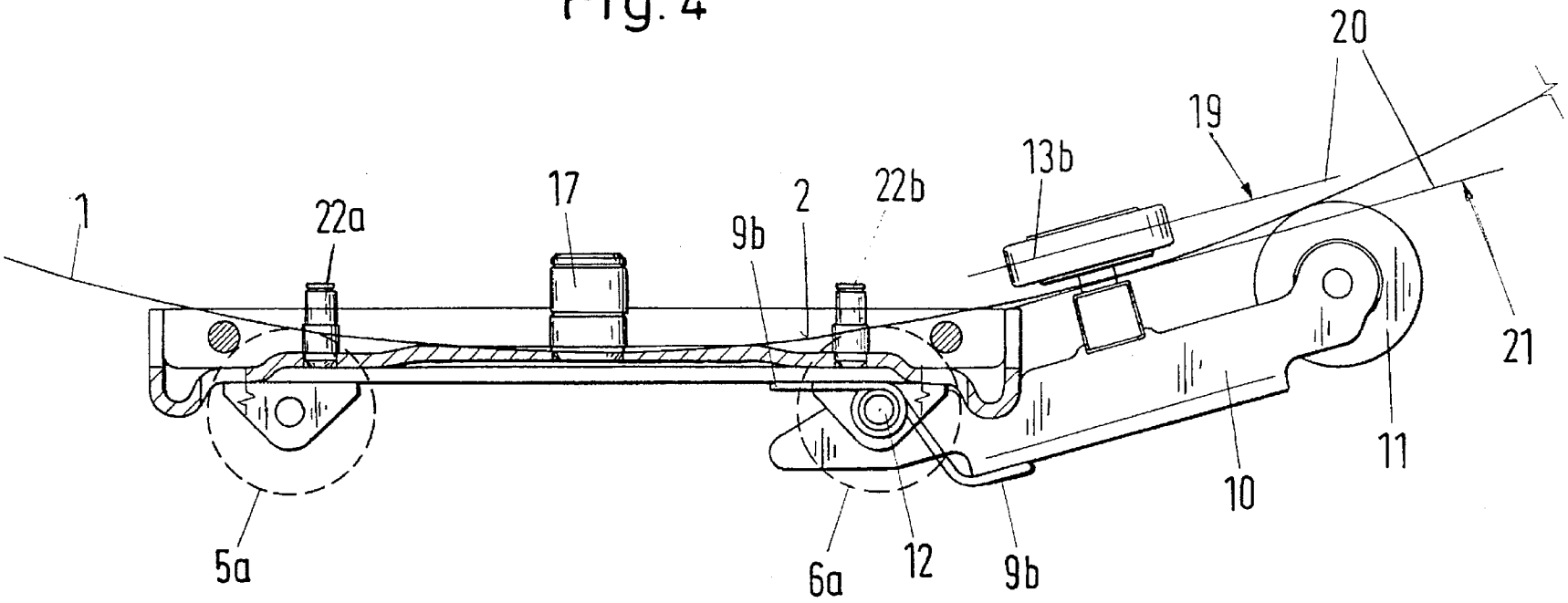
FIG. 4 is a top view along the course of the monorail flange beam with the inventive travelling mechanism placed on it.

As FIG. 4 shows, the travelling direction 19 for the tilt guide rollers 13*a*, 13*b* runs parallel to a tangent 21 to the course of the monorail flange beam 1, so that a parallelism 20 is created between the travelling direction 19 and the tangent 21. This parallelism 20 thus ensures that the tilt guide rollers 13*a*, 13*b* will travel as desired. Furthermore, the journal pins 17 have associated with them auxiliary journal pins 22*a*, 22*b*, on which additional travelling rollers can be arranged in the event that a different travelling roller arrangement is desirable.

The invention is not limited by the embodiments described above which are presented as examples only but can be modified in various ways within the scope of protection defined by the appended patent claims.

I claim:

1. A travelling mechanism for hoisting equipment that runs on a monorail flange beam having a travel path with straight sections and at least one of elevated and laterally curved sections, the travelling mechanism comprising:

two opposed side shield members arranged at a distance from one another;

two pairs of side guide rollers, a respective one of said pairs of side guide rollers being mounted on each one of said side shield members;

at least one travelling wheel rotatably mounted on each of said side shield members between said respective pair of side guide rollers;

travelling drive means for moving the hoisting equipment along the travelling path; and curve travelling means for guiding the mechanism along said curve sections of the beam, the curve travelling means including a rotatably mounted sprung one-armed pivot lever mounted on one of said side shield members so that said pivot lever has a first, free end, said curve travelling means further including an auxiliary side guide roller rotatably mounted to the free end of said pivot lever, and spring means for urging said pivot lever toward the beam, said pivot lever having a second, fork-shaped end that is rotatably mounted on an axis of one side guide roller of one of said pairs of side guide rollers, said spring means including a torsion spring mounted along the axis of the one side guide roller so as to provide a spring force between said pivot lever and said one side shield member so that said pivot lever is rotatably sprung.

2. A travelling mechanism as defined in claim 1, and further comprising a pair of tilt guide rollers centrally disposed on said pivot lever between said one side guide roller and said auxiliary side guide roller.

3. A travelling mechanism as defined in claim 2, wherein at least one of said tilt guide rollers is arranged and adapted to be adjustable to accommodate different monorail flange beams.

4. A travelling mechanism as defined in claim 2, and further comprising means for adjusting at least one of said tilt guide rollers to accommodate different monorail flange beams.

5. A travelling mechanism as defined in claim 2, wherein said side guide rollers and said auxiliary side guide roller have a common diameter.

6. A travelling mechanism as defined in claim 1, and further comprising a pair of tilt guide rollers centrally disposed on said pivot lever between one of the guide rollers of said pair of guide rollers and said auxiliary side roller.

7. A travelling mechanism as defined in claim 6, wherein said side guide rollers and said auxiliary side guide roller have a common diameter.

* * * * *